US008001750B2

(12) United States Patent
Howard

(10) Patent No.: US 8,001,750 B2
(45) Date of Patent: Aug. 23, 2011

(54) APPARATUS, SYSTEM, AND METHOD FOR GUIDING AN ANIMAL

(76) Inventor: Barry Howard, Malad, ID (US)

( * ) Notice: Subject to any disclaimer, the term of this patent is extended or adjusted under 35 U.S.C. 154(b) by 750 days.

(21) Appl. No.: 12/021,962

(22) Filed: Jan. 29, 2008

(65) Prior Publication Data

US 2008/0115468 A1 May 22, 2008

Related U.S. Application Data

(63) Continuation-in-part of application No. 11/499,791, filed on Aug. 7, 2006, now abandoned.

(51) Int. Cl.
*B68B 1/02* (2006.01)
*B68B 1/04* (2006.01)

(52) U.S. Cl. ..... 54/24; 54/85; 54/6.2

(58) Field of Classification Search ..... 54/24, 85, 54/6.1, 6.2

See application file for complete search history.

(56) References Cited

U.S. PATENT DOCUMENTS

| | | | | | |
|---|---|---|---|---|---|
| 280,237 | A | * | 6/1883 | Porter | 54/24 |
| 465,777 | A | * | 12/1891 | Edwards et al. | 54/24 |
| 725,626 | A | | 4/1903 | Noble | |
| 856,415 | A | * | 6/1907 | McClintock | 54/24 |
| 1,116,691 | A | | 11/1914 | Gradberg | |
| 1,278,021 | A | * | 9/1918 | Robinson | 54/24 |
| 1,653,382 | A | | 12/1927 | Wiesenfeld | |
| 1,747,071 | A | * | 2/1930 | Green | 54/85 |
| 2,225,232 | A | | 12/1940 | Ray | 54/6 |
| 2,347,752 | A | | 5/1944 | Schmelz | 54/6 |
| 2,413,426 | A | | 12/1946 | Askin | 54/7 |
| 2,463,279 | A | | 3/1949 | Jones | 54/6 |
| 2,471,121 | A | | 5/1949 | Reed, Jr. | 54/6 |
| 2,623,340 | A | | 12/1952 | Rudolph | 54/6 |
| 2,804,740 | A | | 9/1957 | Newman | 54/6 |
| 2,931,154 | A | | 4/1960 | Sauter | 54/6 |
| 3,149,448 | A | | 9/1964 | Smith | 54/6 |
| 3,458,971 | A | | 8/1969 | Stern et al. | 54/6 |
| 4,472,925 | A | | 9/1984 | Woodruff | 54/24 |
| 5,660,031 | A | | 8/1997 | Clark | 54/71 |
| 7,124,562 | B2 | | 10/2006 | Blocker | |

FOREIGN PATENT DOCUMENTS

WO WO99/62331 12/1999

* cited by examiner

*Primary Examiner* — Son T. Nguyen

(74) *Attorney, Agent, or Firm* — Kunzler Needham Massey & Thorpe

(57) ABSTRACT

An apparatus, system, and method for guiding an animal includes a hackamore for the purpose of riding without a mouth bit, chains or side shanks. Neck reining is encouraged by applying pressure to the neck and the outside of the lower jaw on the same side, which then encourages the horse to bend in the proper direction. Because of the uniquely designed hackamore, the horse is encouraged to stop with minimum pressure. As the neck rein pressure is applied, the plate twists and applies pressure to the side of the jaw, the horse moves away from the pressure providing more control to the rider. Because of the instant release of the pressure, the horse feels the rider's instant and complete release which provides for easier and faster training of the horse. The adjustable nature of the hackamore allows for the rider to fit various animals unique muzzle structure.

14 Claims, 11 Drawing Sheets

APPARATUS, SYSTEM, AND METHOD FOR GUIDING AN ANIMAL

CROSS-REFERENCE TO RELATED APPLICATION

This application is a continuation-in-part of and claims priority to U.S. patent application Ser. No. 11/499,791 entitled "GENTLE CONTROL HACKAMORE" and filed on Aug. 7, 2006 now abandoned for Barry Howard, which is incorporated herein by reference in its entirety.

BACKGROUND OF THE INVENTION

1. Field of the Invention

This invention relates to a device for restraining and controlling an animal, at rest and during exercise, and more particularly to a hackamore which enables gentle control of a horse or other animal.

2. Description of the Related Art

Bridles for the humane restraint and control of horses and other animals generally comprise a head gear consisting of a headstall adapted to be strapped to the horse's head, a mouthpiece or bit connected to the headstall, and a pair of reins connected at opposite ends of the bit. At exercise, whether ridden or driven, by applying pressure on one rein, the rider can pull one end of the bit backward into the horse's mouth and against the tongue, gums, and lips, thereby causing the horse to turn in the direction of the pull in an effort to lessen the discomfort from the bit bearing on the tender tissue of the mouth. By applying pressure on both reins, the rider can pull the bit backward into the horse's mouth and against the soft tissues of both sides of the mouth, with the expectation that the horse will slow or stop in order to minimize its discomfort.

Such bitted bridles, however, are uncertain in their action because they initiate an adversarial relationship between the horse and the rider. For example, the bit causes pain and other reactions that are not consistent with the physiology of exercise. Governance is predicated primarily upon the application of pain to induce submission. Because the bit is a foreign object placed inside the mouth of the horse, many horses react negatively to such a device. Instead of stopping, for example, they sometimes respond to pain by running away or bolting.

Furthermore, many horses balk at or chew the bit, have sore mouths as a result of the bit being placed in their mouth, salivate excessively or misbehave during the process of being bridled and rear their heads so that the bit cannot easily be placed in their mouths in the first instance. Moreover, it is also known that a bit in the horse's mouth often leads to cutting of the tongue, dental pain and severe bruising of the gums and underlying bone. Finally, all bits are counter-productive and contraindicated as, apart from pain, they trigger a cascade of physiological effects that are incompatible with athletic performance. Therefore, bitted bridles are harmful to the horse since control is dependent on painful pressure on the acutely sensitive tissue of the mouth and they stimulate other effects that are inconsistent with the physiological needs of an exercising animal.

For these reasons hackamore-type, or bitless, bridles are often used to break horses or used on horses that have mouth problems, not allowing the use of a bit. Various hackamores have been developed to minimize discomfort to the horse.

One form of bitless bridle, the mechanical hackamore bridle, utilizes rigid shanks which operate such that the application of pressure to the reins results in a leverage action to the jaw. Such bridles, however, are dangerous to the safety of the animal in that they apply severe pressure to the bridge of the nose and the chin. Braking control of the horse is predicated once again on pain, and, as with the bit, upon obstructing the airway by bringing about extreme poll flexion.

Similarly, the mechanical hackamore and other variations on this concept fail to utilize pressure points located on the outside of the lower jaw of the animal. Such pressure points beneficially allow gentle steering control of the animal with limited pressure from the reins. These bridles are disadvantageous in that they apply pressure only to the nose and/or under the chin of the horse rather than at the sensitive pressure points located on the outside of the animals lower jaw.

Finally, none of the previously available bitless bridles are universally applicable to all types of horses, mules, donkeys, or similar animals. Nor are any of the previously available bitless bridles suitable for all types of equestrian sports or activity; different sizes and structures are necessary to accommodate different activities.

From the foregoing discussion, it is apparent that a need exists for a safe, effective, adjustable bitless animal guiding method, apparatus and system. Beneficially, such an apparatus should be designed to be used with a standard headstall and reins and should encourage neck reining. The apparatus should be easily and efficiently manufactured of durable and reliable material at a cost consumers can afford.

SUMMARY OF THE INVENTION

The present invention has been developed in response to the present state of the art, and in particular, in response to the problems and needs in the art that have not yet been fully solved by currently available bitless guiding systems. Accordingly, the present invention has been developed to provide an apparatus, system, and method for guiding an animal that overcome many or all shortcomings in the art.

In one aspect of the invention, an apparatus for use in an animal guidance system includes a control plate configured to hang under an animals jaw and a lateral member attached at an angle to the side of the control plate. In one embodiment, a noseband is attached to the control plate, the noseband configured to attach the control plate to the animal's head. In certain embodiments a rein is attached to the control plate, the rein configured to pivot the control plate in response to pressure applied to the rein.

In a further aspect of the invention, a method of guiding an animal includes applying a first pressure to the outside of an animal's lower jaw and applying a second pressure to the animal's neck. In certain embodiments the second pressure applied to the animals neck is applied on substantially the same side of the animal as the first pressure applied to the animal's lower jaw.

In one aspect of the invention, a hackamore for guiding an animal includes a control plate, a lateral member connected at an angle to the side of the control plate, a noseband attached to the control plate and a rein attached to the control plate.

In a further aspect of the invention, an apparatus for guiding an animal comprises a control plate, a lateral member connected at an angle to the side of the control plate, a noseband attachment aperture disposed within the control plate, a noseband attachment strap disposed within the noseband attachment aperture, a noseband attached to the noseband attachment strap, and a rein attached to the control plate. In certain embodiments the noseband comprises a metal cable encompassed by a braided leather rope to protect the animal's nose.

In one embodiment, an apparatus for guiding an animal includes a control plate having a first and second end. The control plate comprises a plurality of lateral members attached to the side of the control plate at a 45 degree angle in relation to the control plate. A plurality of noseband attachment apertures are disposed substantially in the center of the first end and the second end. A tongue is disposed between the noseband attachment apertures and the second end, the tongue disposed at a 145 degree angle in relation to the control plate. A rein attachment aperture is disposed on the tongue, the rein attachment aperture being disposed proximal the second end of the control plate. A control plate retention attachment slot is disposed at the first end of the control plate. The apparatus for guiding animals, in certain embodiments, also includes an adjustable nose band disposed within the plurality of noseband attachment apertures. An adjustable control plate retention strap is disposed within the control plate retention strap attachment slot. An adjustable throatlatch is attached to the adjustable control plate retention strap. A browband is attached to the adjustable throatlatch. A rein is attached to the rein attachment aperture.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Discussion of the features and advantages, and similar language, throughout this specification may, but do not necessarily, refer to the same embodiment.

The described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments illustrated in the appended drawings, which depict only typical embodiments of the invention and are not to be considered limiting of its scope, in which.

DETAILED DESCRIPTION OF THE INVENTION

It will be readily understood that the components of the present invention, as generally described and illustrated in the figures herein, may be arranged and designed in a wide variety of different configurations. Thus, the following more detailed description of the embodiments of the apparatus, system, and method of the present invention, as presented in FIGS. 1 through 9, is not intended to limit the scope of the invention, as claimed, but is merely representative of selected embodiments of the invention.

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

Figure 1:
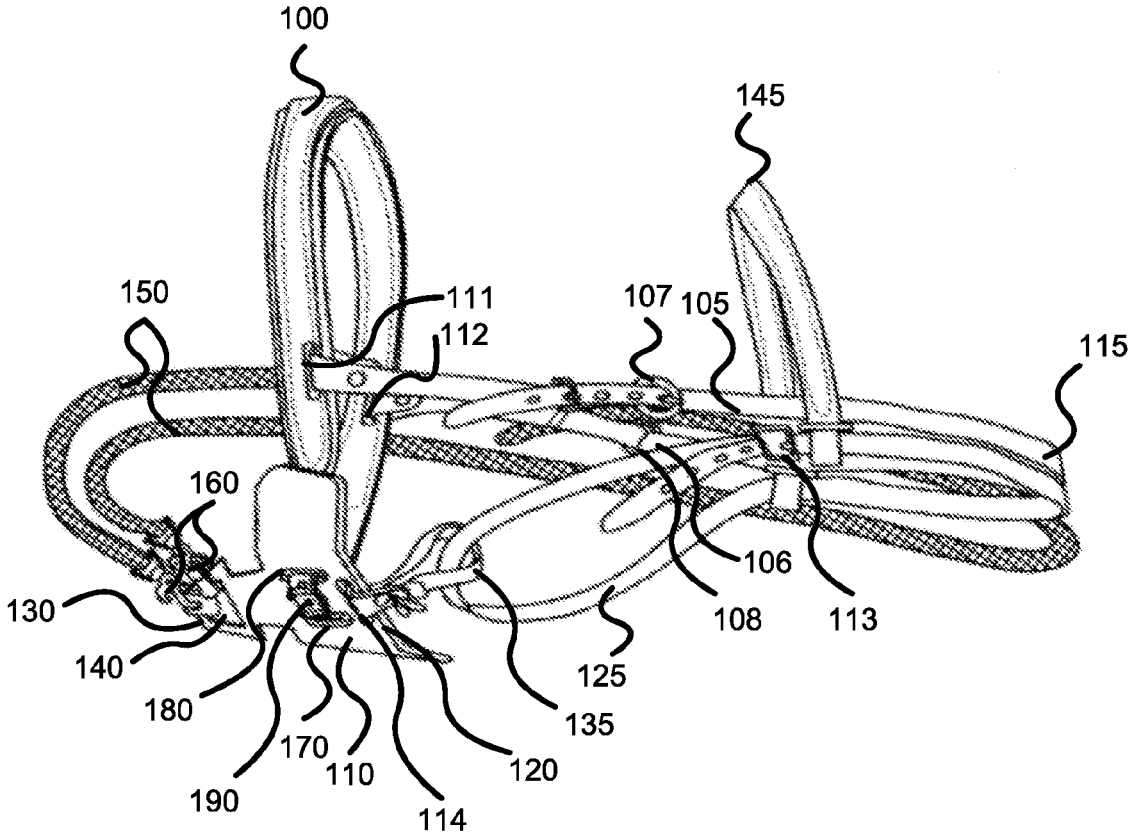
FIG. 1 is a perspective view illustrating one embodiment of an animal guiding apparatus attached to a headstall and reins according to the present invention.

Turning now to FIG. 1, a perspective view of one embodiment of the current invention is shown. When fitted on a horse, mule or donkey and adjusted to the nose properly, a noseband 100 rests on the bridge of the animal's nose. The noseband 100 may be made of leather, synthetic leather, fabric or other material for comfort on the animal. The noseband 100 may also be padded for the animal's comfort. The noseband 100 connects to the control plate 110 through noseband attachment apertures 170 and 180. In one embodiment of the current invention, the noseband 100 is affixed by sliding the two ends of the noseband 100 through the noseband attachment apertures 170 and 180 and adjustably affixing them to one another. The ends may be affixed by use of a buckle, cam device, Velcro or other suitable means for connecting two straps to each other. Alternatively, each end of the noseband 100 may be separately affixed to the control plate 110.

The noseband 100 is connected to a control plate 110 which hangs below the animal's lower jaw. In one embodiment, the control plate 110 rests about one inch below the animal's lower jaw and is parallel with the jaw. To achieve a one inch gap between the control plate 110 and the animal's lower jaw, the length of the noseband 100 is adjustable by a buckle 190 or other adjustment means as is known in the art.

To achieve a parallel alignment with the animal's lower jaw, an adjustable throatlatch 125 is provided which runs over the animal's poll. Attached to the throatlatch 125 is a control plate retention strap 135 which is similarly adjustable. When fitted to the animal, throatlatch 125 is tightened under the animals jaw and held in place by a buckle 113 or other adjustment means as is known in the art. When the throatlatch 125 is tightened around the animals jaw, the throatlatch 125 is maintained in this position. A control plate retention strap 135 is attached at one end to the control plate 110 through a control plate retention strap slot 114 located on the control plate 110. The other end of the control plate retention strap 135 is attached to the throatlatch 125. The control plate retention strap 135 can then be adjusted to maintain a parallel alignment of the control plate with the animal's jaw. In certain embodiments, a browband 145 may be attached to the throatlatch 125 to maintain the position of the bridle on the animal's head.

Additional adjustments to the fit of the bridle may be accomplished through additional adjustment points 107 and 108 on cheekpiece 105 and 106 respectively. Cheekpieces 105 and 106 may run from the noseband 100 to the crownpiece 115. The cheekpieces 105 and 106 are attached to the noseband 100 at attachment slots 111 and 112. The cheekpieces 105 may be adjusted by use of a buckle, cam device, Velcro or other such adjustment means. The adjustment will depend on the anatomy of the animal upon which the current invention is placed.

The control plate comprises a first end 120 and a second end 130 and is made of a rigid material such as plastic or metal. A rein attachment aperture 140 is located in the second end 130 of the control plate 110 to attach reins 150 to the control plate 110. Rein attachment clips 160 may be provided for attaching the reins 150 to the control plate 110. In one embodiment the reins 150 may be directly attached to the control plate 110 at the rein attachment point 140.

Figure 2:
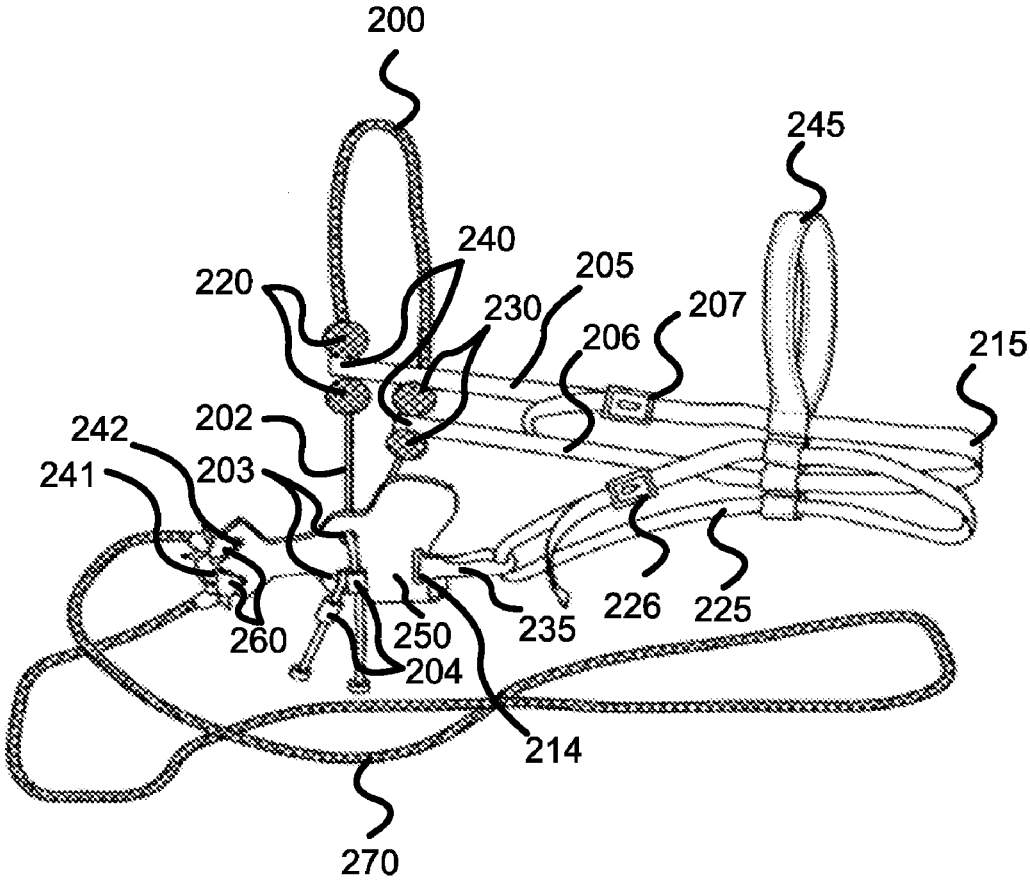
FIG. 2 is a perspective view illustrating another embodiment of an animal guiding apparatus attached to a headstall and reins according to the present invention.

FIG. 2 illustrates another embodiment of the present invention. In this embodiment, a metal cable 202 covered in leather or other material may comprise the noseband 200. The leather or other material is braided around the metal cable 202 to prevent chafing on the animal's nose. In certain embodiments the leather or other material may be sewn in a manner to cover the metal cable 202. In other embodiments, the metal cable may be left bare. Enlarged portions 220 and 230 may comprise braided leather and may provide attachment channels 240 for attaching cheekpiece's 205 and 206. Cheekpiece's 205 and 206 may have a Conway buckle 207 to adjust the device to accommodate different animals' anatomy. While the illustrated embodiment shows a Conway buckle as the adjustment means, one skilled in the art will recognize that other adjustment means may be used.

The noseband 200 is connected to a control plate 250 which hangs below the animal's lower jaw. To connect the noseband 200 to the control plate 250, the metal cable 202 is disposed through noseband attachment apertures 203. The metal cable 202 is maintained within the noseband attachment apertures 203 by retention collars 204 held in place by a set screw. The retention collars 204 allow the noseband to be adjusted to accommodate different facial anatomy of the animal.

Rein attachment apertures 241 and 242 are disposed in the control plate 250 to attach reins 270. Rein attachment clips 260 are provided for attaching the reins 270 to the control plate 250. In certain embodiments the reins 270 may be directly attached to the control plate 250 at the rein attachment apertures 241 and 242.

To achieve a parallel alignment between the control plate 250 and the lower jaw, an adjustable throatlatch 225 runs over the animal's poll and is adjusted by a Conway buckle 226 or other adjustment mechanism. When the throatlatch 225 is tightened around the jaw, the throatlatch is maintained about the jaw. A control plate retention strap 235 attached to the throatlatch 225 may then be adjusted to maintain a parallel alignment of the control plate 250 with the lower jaw. The control plate retention strap 235 is attached to the control plate 250 through a control plate retention strap attachment slot 214 located on the control plate 250.

Cheekpieces 205 and 206 are connected to form a crownpiece 215 which loops around the animal's poll behind its ears. The throatlatch strap 225 may also loop around the animal's poll behind its ears. In certain embodiments, a browband 245 may be attached to the throatlatch 225 to maintain the position of the bridle on the animal's head.

Figure 3:
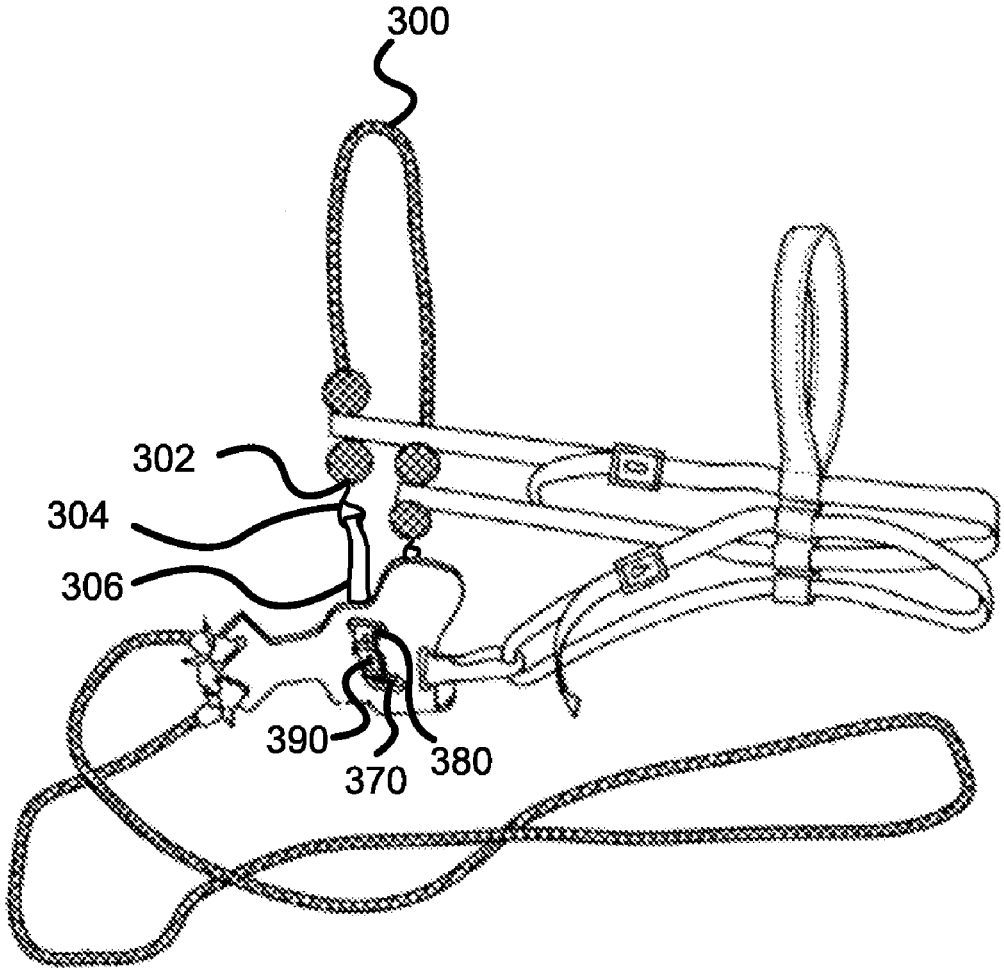
FIG. 3 is a perspective view illustrating another embodiment of an animal guiding apparatus attached to a headstall and reins according to the present invention.

The embodiment illustrated in FIG. 3 is substantially similar to FIG. 2 except for the noseband attachment. The noseband 300 may comprise a metal cable 302 wrapped in leather or other material to protect the animal's nose. The cable 302 may form a loop 304 to attach a noseband adjustment strap 306. The noseband adjustment strap 306 may connect to the control plate 110 through noseband attachment apertures 370 and 380. Adjustment of the noseband adjustment strap 306 and subsequently the noseband 300 is made through a buckle 390 or other adjustment means as is known in the art.

Figure 4:
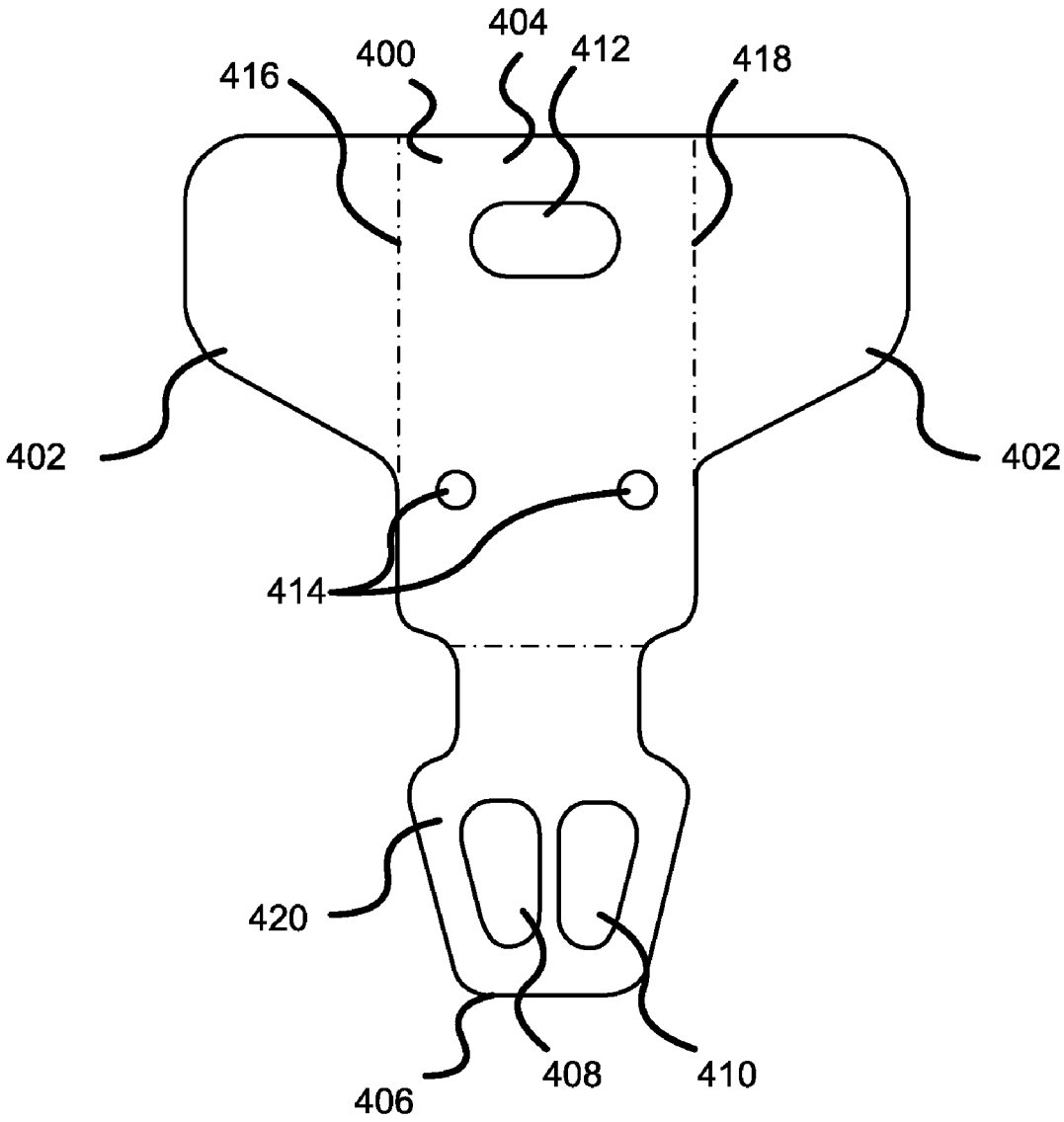
FIG. 4 is a top view of a control plate according to one embodiment of the current invention.

FIG. 4 illustrates a control plate 400 according to one embodiment of the current invention. In certain embodiments, the control plate 400 measures about 6 inches by about 6 inches. The control plate 400 is constructed of metal, plastic or other rigid material. The control plate may comprise a first end 404 and a second end 406. A control plate strap retention attachment slot 412 is disposed proximal the first end 404 of the control plate 400. Noseband attachment apertures 414 are disposed substantially in the middle of the control plate 400 between the first end 404 and the second end 406. The noseband attachment apertures 414 are substantially circular to maintain a metal noseband cable, such as noseband 202 of FIG. 2, therein.

Lateral members 402 are disposed on either side of the control plate 400 between the noseband attachment apertures 414 and the first end 404. The lateral members 402 are substantially elevated from the plane of the control plate 400. In certain embodiments the lateral members 402 and the control plate 400 may comprise separate elements attached to each other such that the lateral members 402 are substantially elevated from plane of the control plate 400. In the illustrated embodiment, the lateral members 402 and the control plate 400 may comprise a solid, unitary material wherein the lateral members 402 are bent upwards along lines 416 and 418.

Rein attachment slots 408 and 410 are disposed proximal the second end 406 of the control plate 400. In certain embodiments, not shown, the rein attachment slot may comprise a single opening for attaching the reins. The rein attachment apertures are disposed on a tongue 420 located between the noseband attachment apertures 414 and the second end 406.

Figure 5A:
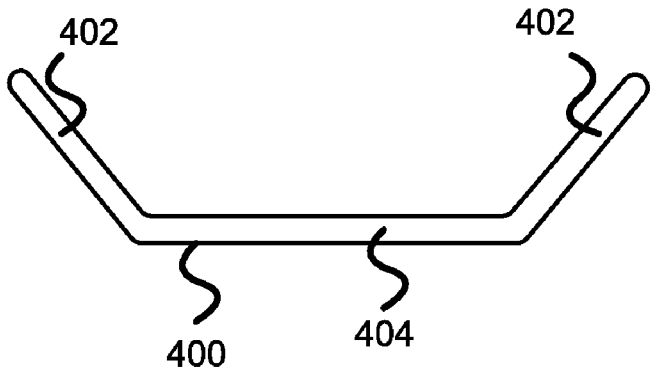
FIG. 5A is an end-on view looking down the plane of a control plate according to one embodiment of the current invention.
Figure 5B:
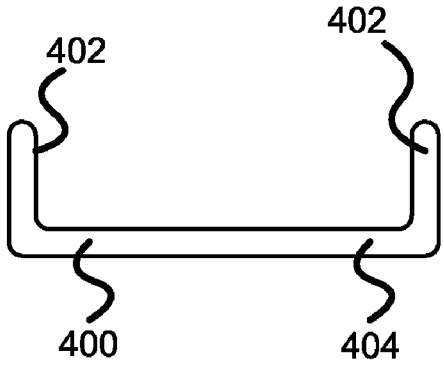
FIG. 5B is an end-on view looking down the plane of a control plate according to one embodiment of the current invention.
Figure 5C:
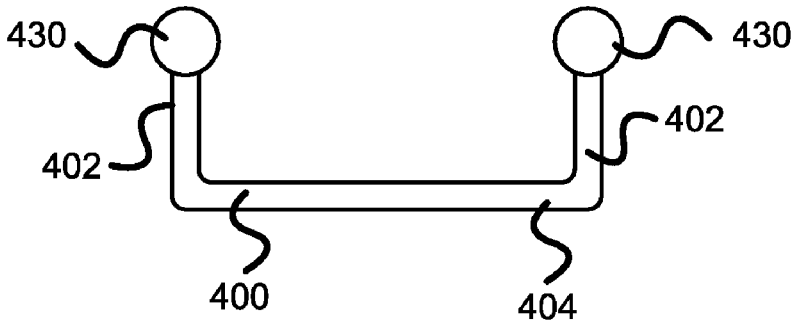
FIG. 5C is an end-on view looking down the plane of a control plate according to one embodiment of the current invention.

FIG. 5A illustrates an end on view looking at the first end 404 along the plane of the control plate 400. In certain embodiments, lateral members 402 may be disposed at about a 45 degree angle relative to the plane of the control plate 400. In other embodiments, such as the embodiment illustrated in FIG. 5B, the lateral members 402 may be disposed at about a 90 degree angle relative to the plane of the control plate 400. In certain embodiments, such as the embodiment illustrated in FIG. 5C, a nodule 430 may be disposed on top of each lateral member to provide directed pressure to the pressure points located on the side of the animals head.

Figure 6A:
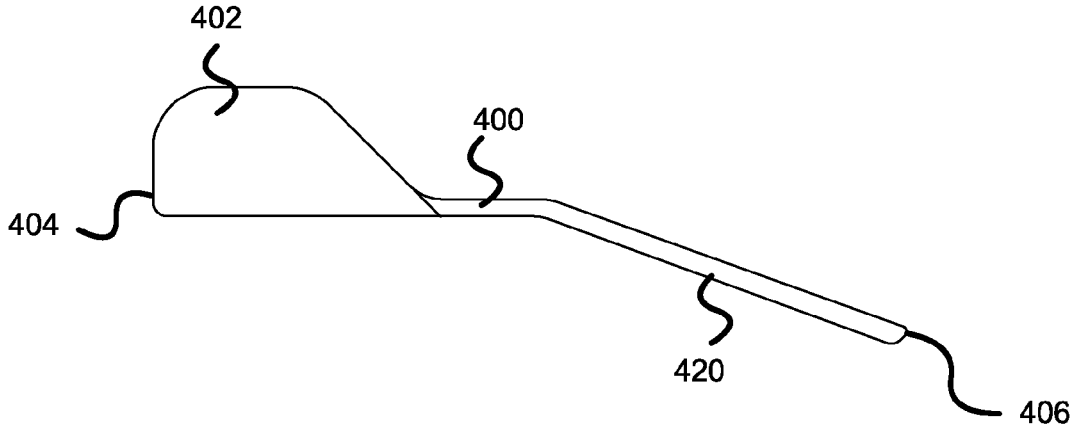
FIG. 6A is a side view of a control plate according to one embodiment of the current invention.
Figure 6B:
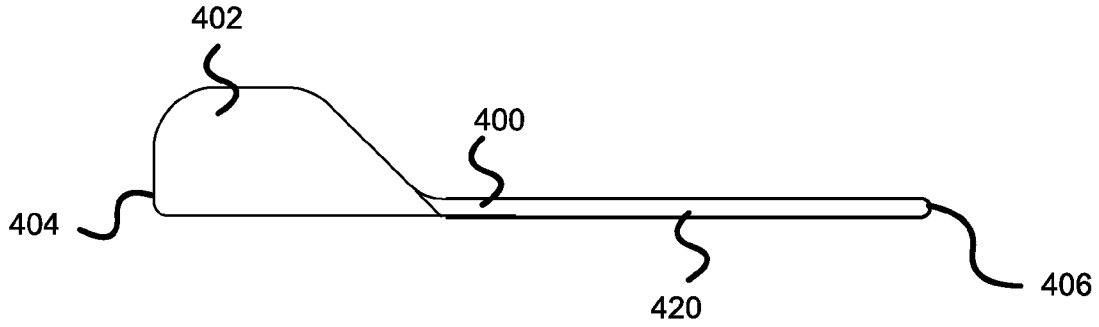
FIG. 6B is a side view of a control plate according to one embodiment of the current invention.

FIGS. 6A and 6B illustrate a side view of the control plate 400, tongue 420 and lateral members 402 according to one embodiment of the current invention. In the embodiment illustrated in FIG. 6A the tongue is disposed at about a 45 degree angle relative to the plane of the control plate 400. In other embodiments certain embodiments the tongue 420 is disposed in substantially the same plane as the control plate 400.

Figure 7:
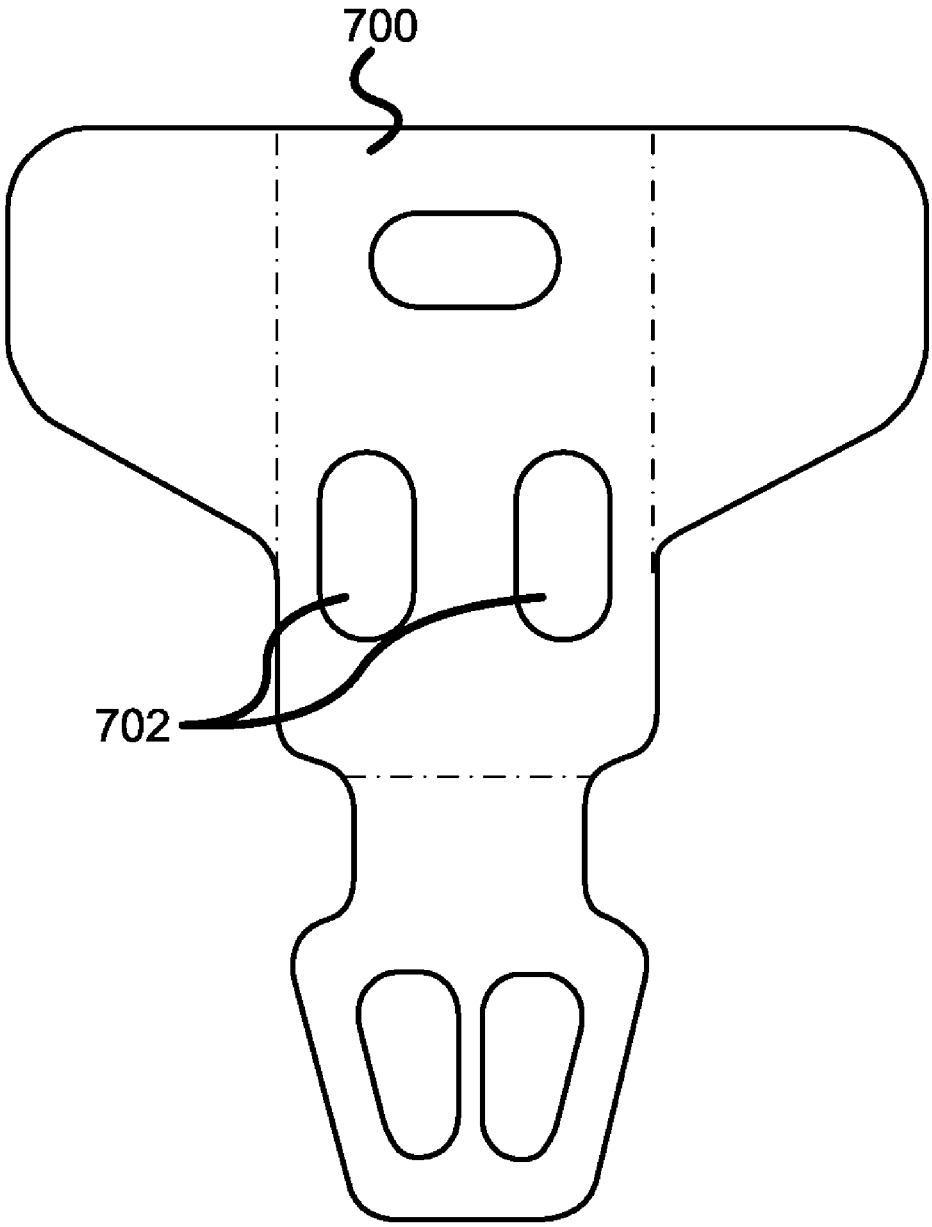
FIG. 7 is a top view of a control plate according to one embodiment of the current invention.

FIG. 7 illustrates an embodiment of a control plate 700 in which noseband attachment apertures 702 are disposed at about the center of the control plate 700. In use, the noseband adjustment strap 306, as illustrated in FIG. 3, is disposed through the noseband attachment apertures 702. The noseband adjustment strap 306 is adjustably connected under the control plate 700. In certain embodiments, a flat noseband, such as noseband 100 of FIG. 1, is disposed through the noseband attachment apertures 702. The noseband 100 may be adjustably connected under the control plate 700 as illustrated in FIG. 1.

Figure 8:
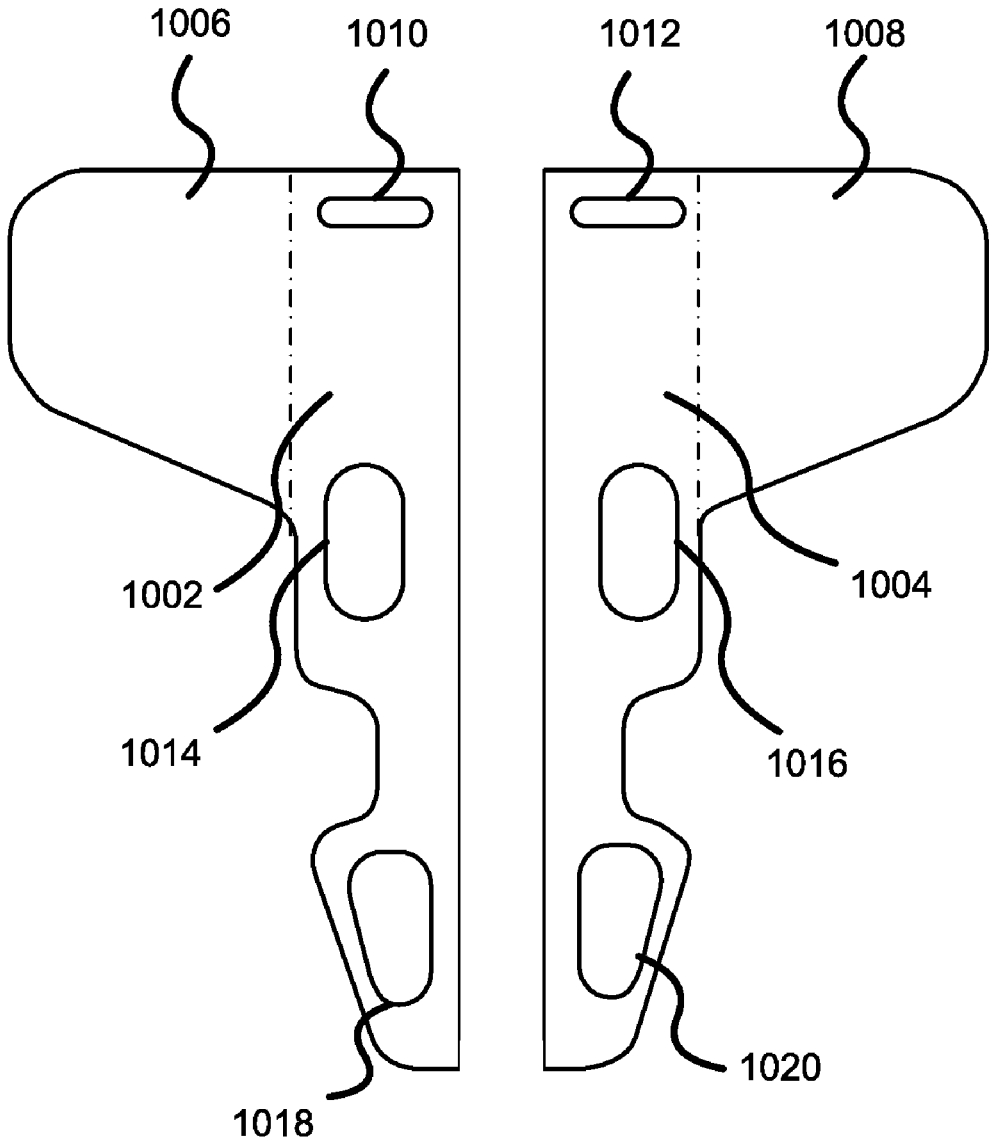
FIG. 8 is a top view of a split control plate according to one embodiment of the current invention.

FIG. 8 illustrates an embodiment of the current invention in which the apparatus comprises two independent control plates 1002 and 1004. The control plates 1002 and 1004 are mirror images of each other and have a lateral member 1006 and 1008 disposed at the side of the control plate 1002 and 1006 respectively. Control plate retention slots 1010 and 1012 are disposed on each control plate 1002 and 1004 and serve to retain the control plates 1002 and 1004 in a position substantially parallel to the animal's lower jaw. A noseband attachment slot 1014 and 1016 is disposed on each control plate 1002 and 1004. Rein attachment points 1018 and 1020 are disposed on each control plate 1002 and 1004 respectively and serve to pivot the control plate when pressure is applied to the rein.

Figure 9:
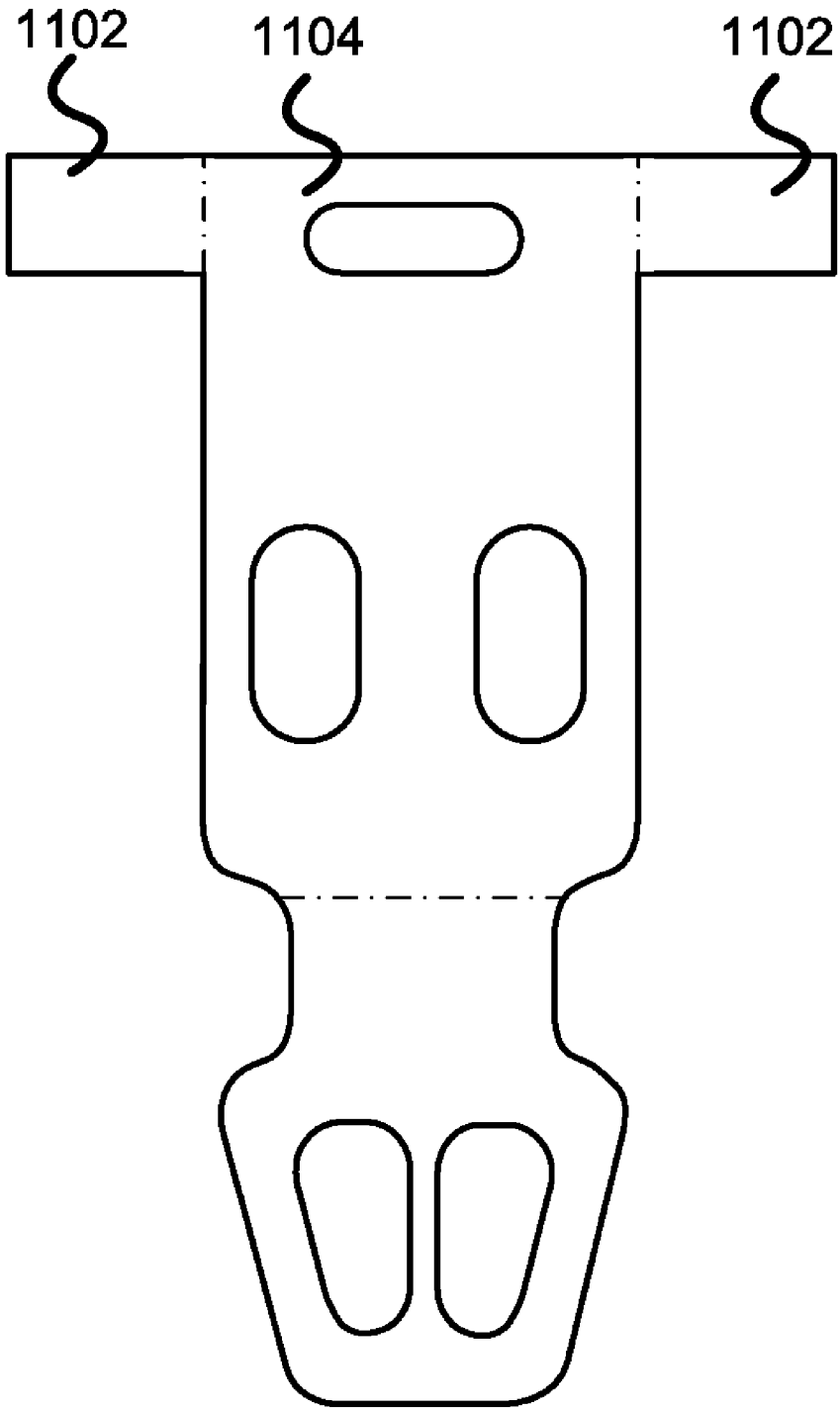
FIG. 9 is a top view of a control plate according to one embodiment of the current invention.

In the embodiment illustrated in FIG. 9, the lateral members 1102 may comprise tabs disposed on each side of the control plate 1104. In certain embodiments the lateral members 1102 are disposed at about a 45 degree angle in relation to the plane of the control plate 1104. In other embodiments the lateral members 1102 may be disposed at about a 90 degree angle in relation to the plane of the control plate 1104.

Figure 10:
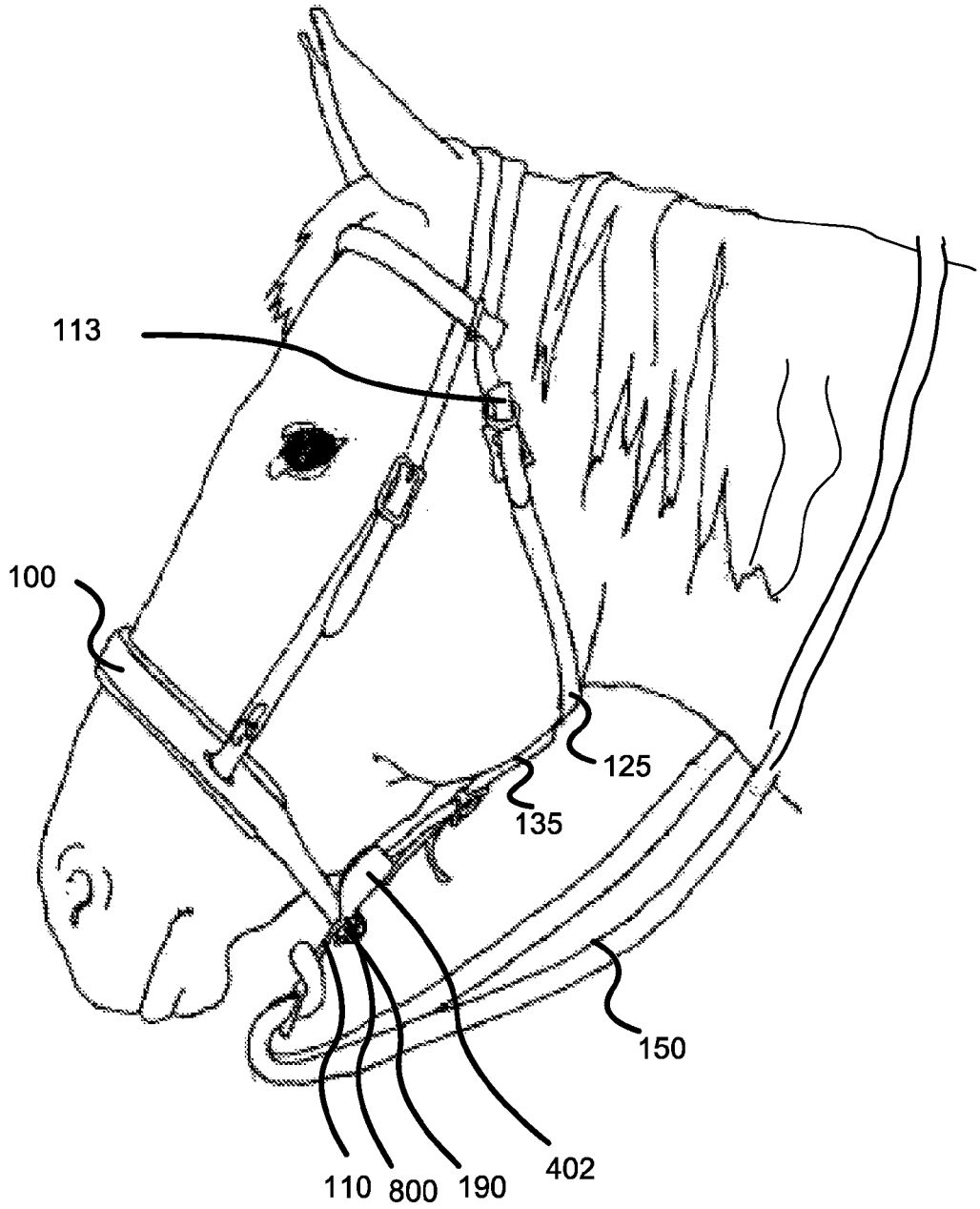
FIG. 10 is a side view of an animal guiding apparatus installed on a horse according to one embodiment of the current invention.

Turning now to FIG. 10 illustrating one embodiment of the current invention fitted to a horse. In use, a buckle 190 adjusts the noseband 100 to provide about a one inch gap between the control plate 110 and the lower jaw. The throatlatch 125 is adjusted by buckle 113 to secure the throatlatch 125 around the jaw of the animal. An adjustable control plate retention strap 135 is connected to the throatlatch 125 at one end and the control plate 110 at the other end. Adjustments to the control plate retention strap 135 may maintain the control plate parallel to the lower jaw of the animal. Thus, by adjusting the noseband 100 and the control plate retention strap 135, the control plate may hang about one inch below and approximately parallel to the animal's lower jaw.

The control plate 110 may hang by the noseband 100 such that the control plate 110 may pivot around the connection between the control plate 110 and the noseband 100 at a pivot point 800. The control plate 110 may pivot in response to pressure applied from the reins 150. As the control plate 110 rotates about the pivot point 800, lateral members 402 are forced into the pressure points located on the outside of the lower jaw of the animal. The pressure applied to the reins 150 to rotate the control plate 110 may result in pressure applied to the animal's neck on the same side as the pressure applied to the lower jaw of the animal.

As is known in the art, an animal tends to move away from pressure. Therefore, the current invention encourages neck reining, a trait desirable in training a horse, mule or donkey. This neck reining encouragement results from pressure applied to the same side of the lower jaw as the pressure applied to the neck. The pressure encourages the horse to bend in the proper direction.

When pressure is applied to both reins 150 at the same time, the control plate 110 will not rotate. Instead, the control plate 110 will lever into the lower jaw of the animal and pull the noseband 100 tighter onto the nose of the animal. Because the pivot point 800 is disposed in about the center of the device, the control plate 110 may provide a one to one pressure ratio when pressure is applied to the reins. Similarly, the noseband 100 is lower on the animal's head than where the control plate 110 contacts the underside of the lower jaw. This action encourages the animal to break at the poll and round up its shoulders. Because of the uniquely designed Hackamore, the horse is encouraged to collect and back up with minimum pressure applied to the reins 150.

The current invention, when adjusted to hang about one inch below and approximately parallel with the animals lower jaw, will give instant release of pressure to the animal when rein tension has been released. This almost instant release of pressure encourages faster training of the animal than can be achieved with conventional hackamores, bits, and bridles.

The current device may be used with standard headstalls and reins equipped with a throatlatch. Thus, the device will give the horse, mule or donkey maximum comfort and the rider maximum safe control.

Figure 11:
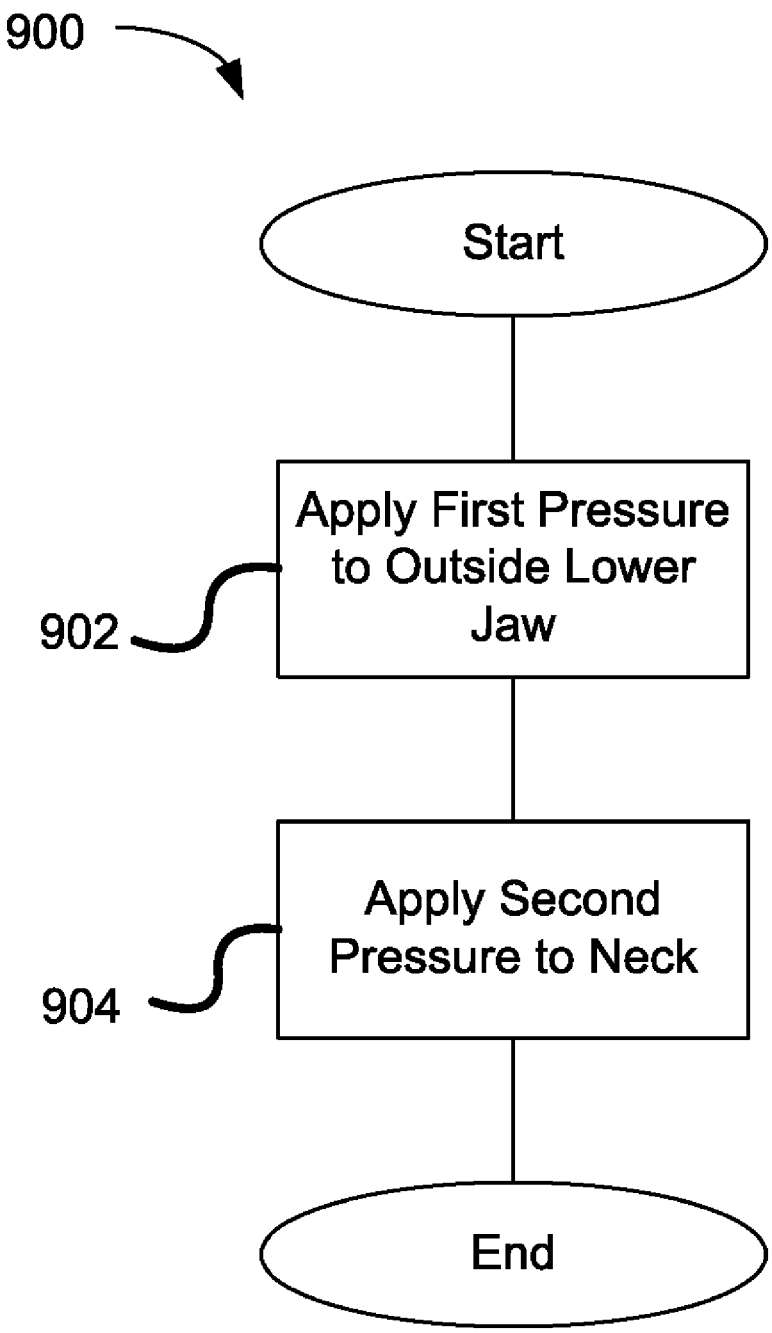
FIG. 11 is a schematic flow chart diagram illustrating an embodiment of a method of guiding and animal according to the present invention.

The schematic diagram illustrated in FIG. 11 is generally set forth as a logical flow chart diagram depicting a method for guiding an animal. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Additionally, the order in which a particular method occurs may or may not strictly adhere to the order of the corresponding steps shown.

FIG. 11 illustrates a method 900 of guiding an animal according to one embodiment of the current invention. A first pressure is applied 902 to an animal's lower jaw. A second pressure is applied 902 to the animal's neck. The first pressure and the second pressure are applied 902 and 904 on substantially the same side of the animal. The first pressure and the second pressure applied 902 and 904 are approximately simultaneous.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hackamore for guiding an animal, the hackamore comprising:

a control plate comprising a rein attachment end disposed opposite a free end, the rein attachment end having a rein attachment member;

a lateral member connected at an angle to a side of the control plate proximal the free end, wherein the lateral member is substantially free of an attachment member;

a noseband attachment member disposed in approximately a longitudinal center of the control plate between the rein attachment end and the free end;

a noseband coupled to the noseband attachment member, the coupling between the noseband and the noseband attachment member facilitating rotation of the control plate along a plane substantially parallel to an animal's lower jaw; and a second lateral member and a control plate retention strap, the second lateral member connected at an angle to a side of the control plate opposite the lateral member, the control plate having control plate retention strap attachment member positioned between the lateral member and the second lateral member and proximate the free end of the control plate, the control plate retention strap attached to the control plate retention strap attachment member.

2. The hackamore according to claim 1, wherein the control plate hangs about 1 inch below and parallel to the animal's lower jaw when the hackamore is on the animal.

3. The hackamore according to claim 1, wherein the noseband attachment member comprises a noseband attachment aperture and wherein the noseband is attached to the control plate at the noseband attachment aperture.

4. The hackamore according to claim 3, wherein the noseband comprises a flat strap disposed through the noseband attachment aperture.

5. The hackamore according to claim 3, wherein the noseband comprises a metal cable encompassed by a braided leather rope.

6. The hackamore according to claim 5, wherein the metal cable is disposed through the noseband attachment aperture.

7. The hackamore according to claim 5, wherein the metal cable is attached to a noseband attachment strap disposed through the noseband attachment aperture.

8. The hackamore according to claim 1, wherein the lateral member is disposed at approximately a 45 degree angle in relation to the control plate.

9. The hackamore according to claim 1, further comprising a tongue attached to the control plate and oriented at approximately a 145 degree angle in relation to the control plate, and a rein attachment aperture disposed within the tongue.

10. An apparatus for guiding an animal, the apparatus comprising:

a control plate comprising a rein attachment end disposed opposite a free end, the rein attachment end having a rein attachment member;

a pair of lateral members connected at an angle to opposing sides of the control plate proximal the free end, wherein the lateral members are substantially free of an attachment member and wherein the free end of the control plate includes a control plate retention strap attachment member disposed in approximately a lateral center of the control plate between the pair of lateral members;

a noseband attachment member disposed in approximately a longitudinal center of the control plate between the rein attachment end and the free end;

a noseband attached to the to the noseband attachment member, the coupling between the noseband and the noseband attachment member facilitating rotation of the control plate along a plane substantially parallel to an animal's lower jaw;

a control plate retention strap coupled to the control plate retention strap attachment member; and a rein attached to the rein attachment member.

11. A method of guiding an animal, the method comprising:

providing a hackamore for guiding an animal, the hackamore comprising: a control plate comprising a rein attachment end disposed opposite a free end, the rein attachment end having a rein attachment member; a lateral member connected at an angle to a side of the control plate proximal the free end, wherein the lateral member is substantially free of an attachment member; a noseband attachment member disposed in approximately a longitudinal center of the control plate between the rein attachment end and the free end; a noseband coupled to the noseband attachment member, the coupling between the noseband and the noseband attachment member facilitating rotation of the control plate along a plane substantially parallel to an animal's lower jaw; and a second lateral member and a control plate retention strap, the second lateral member connected at an angle to a side of the control plate opposite the lateral member, the control plate having control plate retention strap attachment member positioned between the lateral member and the second lateral member and proximate the free end of the control plate, the control plate retention strap attached to the control plate retention strap attachment member;

applying a first pressure to the outside of an animal's lower jaw; and applying a second pressure to the animal's neck.

12. The method according to claim 11, wherein the second pressure applied to the animal's neck is on substantially the same side of the animal as the first pressure applied to the animal's jaw.

13. The method according to claim 12, wherein the first pressure and the second pressure are applied substantially simultaneously.

14. The method according to claim 12, wherein the first pressure is applied by a plate and the second pressure is applied by a rein.

* * * * *